US005319891A

United States Patent [19]

Becker

[11] Patent Number: 5,319,891

[45] Date of Patent: Jun. 14, 1994

[54] METHOD OF AND TOOL FOR FINE-MACHINING A PART-SPHERICAL WORKPIECE

[75] Inventor: Manfred G. Becker, Novi, Mich.

[73] Assignee: Ernst Thielenhaus KG, Wuppertal, Fed. Rep. of Germany

[21] Appl. No.: 928,004

[22] Filed: Aug. 10, 1992

[30] Foreign Application Priority Data

Nov. 23, 1991 [DE] Fed. Rep. of Germany ..... 4138566

[51] Int. Cl.[5] ..... B24B 11/00; B24D 7/18

[52] U.S. Cl. ..... 51/281 R; 51/206 R; 51/289 R; 51/129

[58] Field of Search ..... 51/206 R, 281 R, 289 R, 51/129, 131.1, 134.5

[56] References Cited

U.S. PATENT DOCUMENTS

| | | | |
|---|---|---|---|
| 220,911 | 10/1879 | Cogswell | 51/206 R |
| 335,890 | 2/1886 | Call | 51/206 R |
| 1,525,337 | 2/1925 | Svensson | 51/131.1 |
| 2,482,485 | 9/1949 | Hutchinson | 51/289 R |
| 2,514,155 | 7/1950 | Fisher | 51/134.5 R |
| 2,982,057 | 5/1961 | Stanhope | 51/289 R |

OTHER PUBLICATIONS

Article "Maschinen Für die Bearbeitung von Endoprothesen" by G. Scherber (*Industriediamantrundschau* 17, 1983).

*Primary Examiner*—Jack Lavinder

*Attorney, Agent, or Firm*—Herbert Dubno; Andrew Wilford

[57] ABSTRACT

A part-spherical surface having a center of curvature at a workpiece axis is surface finished by rotating the workpiece about the workpiece axis and rotating about a tool axis a tool having a body of substantially greater diameter than the workpiece. The tool has an end formed by a part-spherical seat of the same radius of curvature as the workpiece surface, having a center of curvature on the tool axis, and having an outer periphery of predetermined diameter substantially less than the tool-body diameter, and by a generally frustoconical surface centered on the tool axis and having a small-diameter end adjacent and of generally the same diameter as the seat outer periphery and a large-diameter end spaced axially rearwardly therefrom and joined to the tool body. The tool and workpiece axes are tilted relative to each other so they intersect at an obtuse attack angle smaller than 180° and the tool and workpiece are pressed axially together to engage the surfaces together. The outer-periphery diameter and the attack angle are such that when axially engaged a portion of the workpiece surface is not covered by the tool surface and a portion of the tool surface is not engaged by the workpiece surface so that as the tool wears the outer-periphery diameter increases. The tool is replaced with a fresh tool when the outer-periphery diameter increases so much that practically all of the workpiece surface is covered by the tool surface.

9 Claims, 4 Drawing Sheets

METHOD OF AND TOOL FOR FINE-MACHINING A PART-SPHERICAL WORKPIECE

FIELD OF THE INVENTION

The present invention relates to fine machining—polishing, honing, or burnishing—a part-cylindrical surface of a workpiece. More particularly this invention concerns a tool for doing such machining.

BACKGROUND OF THE INVENTION

It is frequently necessary to machine a part-spherical surface on a workpiece, in particular on the end of a rod. This can be done most accurately by rotating the rod about its longitudinal axis, which crosses the center of curvature of the surface to be machined, and pressing it axially against a concave grinding or machining tool rotated about a tool axis that forms an obtuse angle of less than 180° to the workpiece axis.

Typically as described in "Maschinen für die Bearbeitung yon Endoprothesen" by G. Scherber (Industriediamantrundschau 17, 1983) the tool is tubular and has a diameter substantially smaller than that of the rod whose end surface is being ground. Thus the workpiece is engaged over an annular region that extends from its outer periphery to the tool axis so that as the workpiece and tool are rotated every portion of the tool surface is contacted by the workpiece surface. The result is therefore a perfectly part-spherical surface centered on the point where the tool and workpiece axes intersect. Under ideal operating conditions the tool surface will wear uniformly so that the tubular rod forming the tool gets shorter but otherwise remains usable.

Such a procedure is extremely effective when dealing with a large-diameter workpiece more than a few centimeters in diameter, for instance a ball of a hip prosthesis, because the tool can be made fairly rigid and stiff. Nonetheless when trying to hone or burnish an end of a small-diameter rod, this method does not work because the tool, which must be of similarly small diameter, inherently deforms. Thus putting an accurately finished part-spherical surface on the end of a shaft having a diameter in the millimeter range is a very time-consuming and slow process, in part because one must work with very low pressure to avoid deforming the tool.

OBJECTS OF THE INVENTION

It is therefore an object of the present invention to provide an improved method of fine machining a part-spherical surface of a small-diameter rod.

Another object is the provision of such an improved method of fine machining a part-spherical surface of a small-diameter rod which overcomes the above-given disadvantages, that is which allows the surface to be accurately honed relatively rapidly.

Another object is to provide an improved tool for such a machining operation.

SUMMARY OF THE INVENTION

A part-spherical surface having a center of curvature at a workpiece axis is surface finished by rotating the workpiece about the workpiece axis and rotating about a tool axis a tool having a body of substantially greater diameter than the workpiece. The tool has an end formed by a part-spherical seat of the same radius of curvature as the workpiece surface, having a center of curvature on the tool axis, and having an outer periphery of predetermined diameter substantially less than the tool-body diameter, and by a generally frustoconical surface centered on the tool axis and having a small-diameter end adjacent and of generally the same diameter as the seat outer periphery and a large-diameter end spaced axially rearwardly therefrom and joined to the tool body. The tool and workpiece axes are tilted relative to each other so they intersect at an obtuse attack angle smaller than 180° and the tool and workpiece are pressed axially together to engage the surfaces together. The outer-periphery diameter and the attack angle are such that when axially engaged a portion of the workpiece surface is not covered by the tool surface and a portion of the tool surface is not engaged by the workpiece surface so that as the tool wears the outer-periphery diameter increases. According to the invention the tool is replaced with a fresh tool when the outer-periphery diameter increases so much that practically all of the workpiece surface is covered by the tool surface.

Thus the tool is in effect pointed like a pencil, but with a concave tip serving as the grinding surface. Thus the tool is rigid enough that it does not deform when considerable axial force is brought to bear. Since the work piece surface will wear uniformly, it is merely necessary to change tools when the seat outer-periphery diameter has grown such that the workpiece is wholly recessed in the tool. If this were to happen a projecting rim would form on the tool which would break both the tool and workpiece when they were separated.

The tool end further is formed at the tool axis with an axially centered and forwardly open blind bore of predetermined diameter at the tool surface. The attack angle is such that the bore is radially spaced from the tool axis when the tool and workpiece are axially engaged. The tool is replaced when the tool surface has worn down generally to a floor of the blind bore.

In accordance with further features of this invention the workpiece has a diameter between 1 mm and 5 mm, preferably about 2 mm, and the tool-body diameter is between 2 mm and 20 mm, that is between two and four times the respective workpiece diameter. The frustoconical surface has an apex angle of between 30° and 60°.

According to another feature of the invention the blind bore has an axial depth smaller than the radius of curvature of the workpiece surface, preferably smaller than half the radius of curvature of the workpiece surface. Furthermore the tool end is further formed with a cylindrical extension centered on the axis and extending axially from the outer periphery of the tool surface to the small-diameter end of the frustoconical surface.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
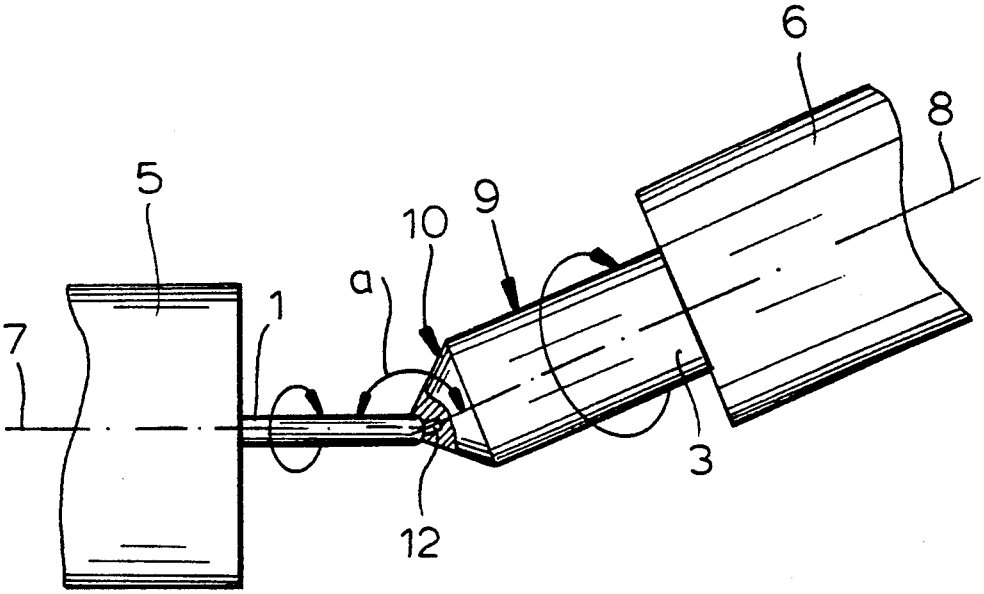
FIG. 1 is a partly diagrammatic side view showing the system of this invention.
Figure 2:
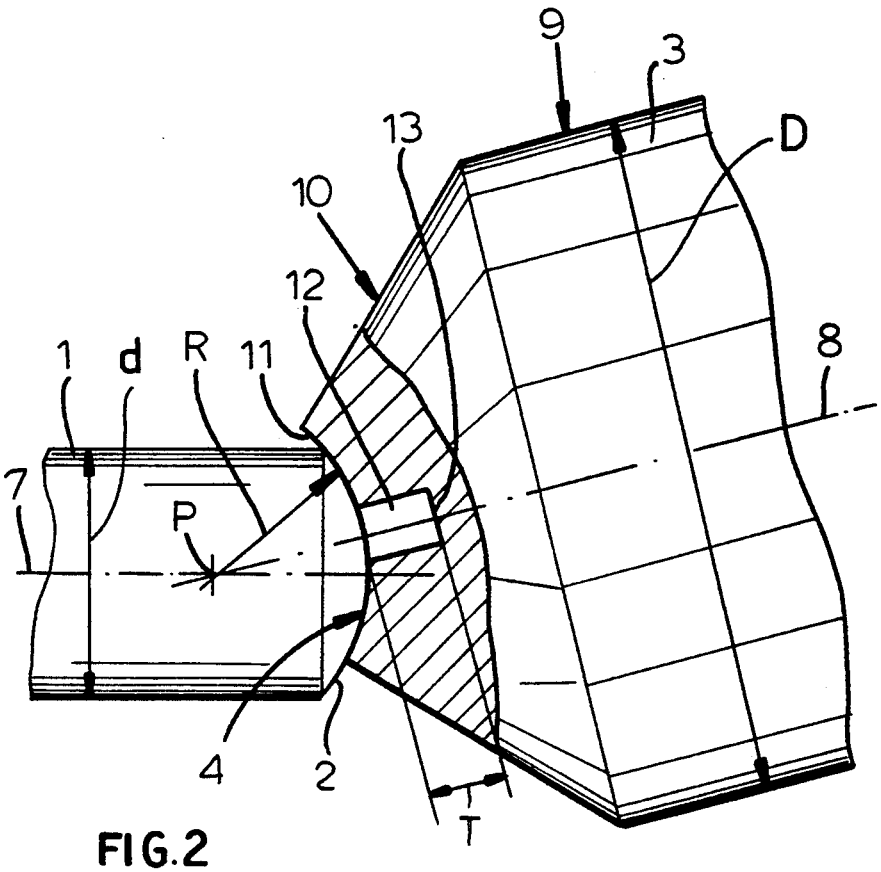
FIGS. 2 and 3 are large-scale detail views of the tool at the start and end of a single machining cycle.

As seen in FIGS. 1 and 2 a cylindrical rod i whose end surface 2 is to be ground or polished to a part-spherical shape of the same outside diameter d of between 1 mm and 5 mm, here 2 mm, as the rod 1 is held in a workpiece chuck 5 and rotated about a workpiece axis 7 which is the longitudinal center axis of the rod 1. A grinding or polishing tool 3 is centered on an axis 8 and is seated in a holding sleeve in turn held in a tool chuck 6 for rotation about this axis 8 with an end 4 of the tool 3 pressed against the surface 2. The axes 7 and 8 intersect at an obtuse angle of about 150° at a point P that lies at the center of the radius R of curvature of the surface 2.

The tool 3 has a cylindrical body 9 centered on the axis 8 and of a relatively large diameter D equal to about three times the diameter d, and is formed with a frustoconical intermediate surface 10 also centered on the axis 8 and of an apex angle of between 30° and 60°. The end 4 is formed by a part-spherical surface 11 of the radius R of curvature and centrally formed on the axis 8 with a blind bore or recess 12 having a flat floor 13.

To start with as seen in FIG. 2 the surface 11 has an outer diameter that is substantially smaller than the diameter d of the rod 1 and the recess 12 has a relatively large depth T. Thus as the workpiece 1 and tool 3 are rotated about their respective axes 7 and 8 every point on the surface 11 will at some time be engaged with the surface 2 and vice versa. Thus the surface 11 will be worn away substantially uniformly, not significantly changing in radius of curvature. As the tool 3 wears, however, the outside diameter of the part-spherical surface 11 increases.

The tool 3 and workpiece i may be rotated about their respective axes 7 and 8 in the same or opposite directions and at the same of different speeds, depending on the amount of material removal or burnishing to be done. The angle a may even be changed, even periodically, during a machining cycle, which is defined as the amount of machining done by a tool 3 before it must be replaced, so long as the angle a is never increased so much that the surface 11 entirely covers the surface 2. Normally also a coolant liquid is supplied to the interface of the surfaces 2 and 11.

Figure 3:
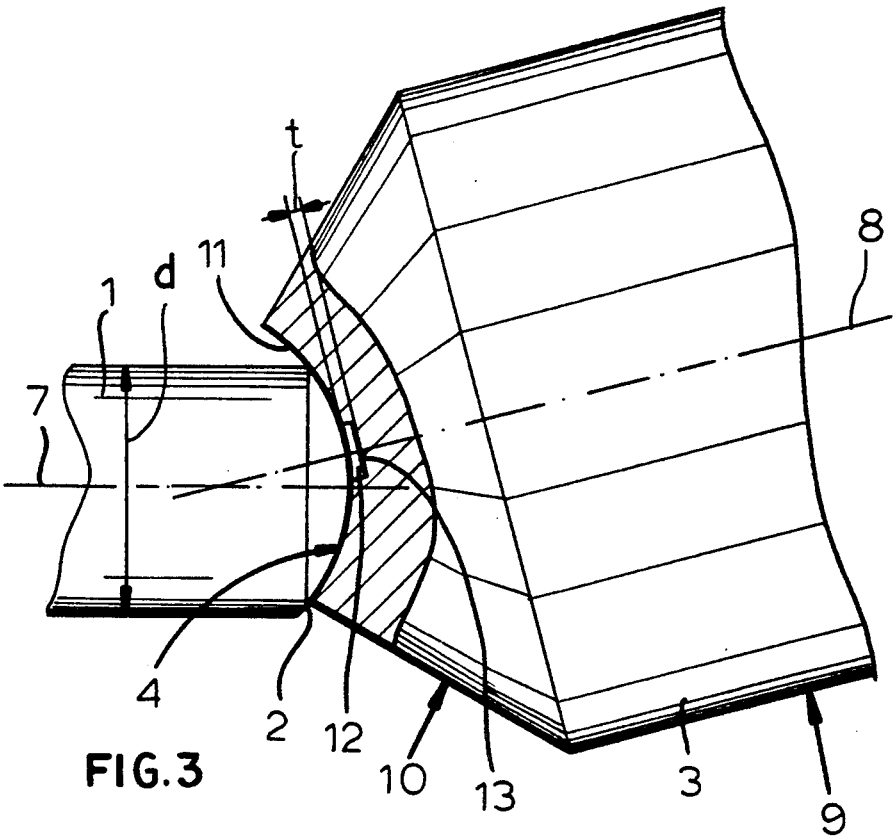

When as seen in FIG. 3 the depth of the hole 12 is reduced to t which is much smaller than the depth T, and when the outside diameter of the surface 11 starts to become so large that the surface 2 no longer is exposed significantly, according to the invention the tool 3 is switched with a fresh one as in FIG. 2 and the tool is reground. If the tool 3 were allowed to wear away such that the surface 2 was wholly engaged within the outer periphery of the surface 11, an annular region of this surface 11 at its outer periphery would no longer engage the surface 2 at any time and tool wear would be uneven.

Figure 4A:
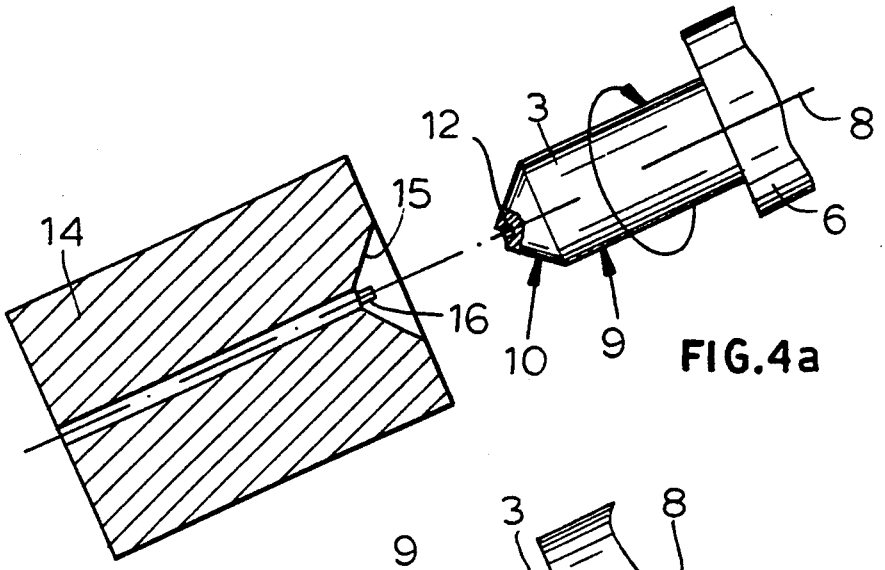
FIGS. 4*a* through 4*d* are diagrammatic views illustrating the steps of regrinding or truing the tool according to the invention.
Figure 4B:
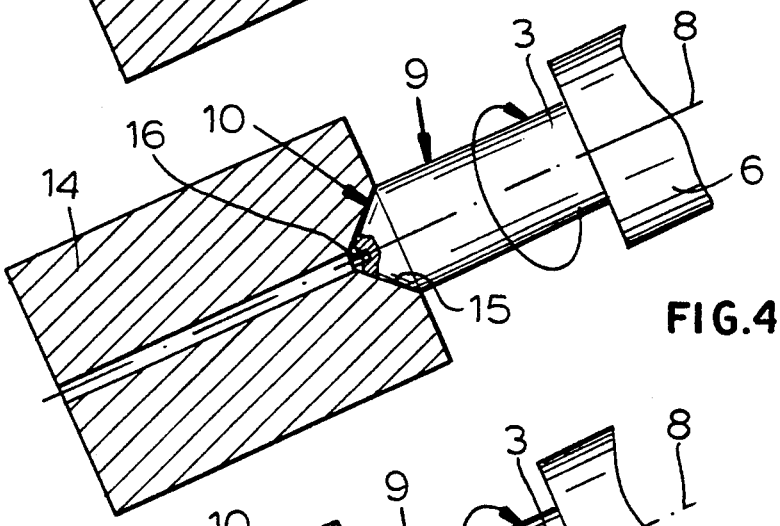
Figure 4C:
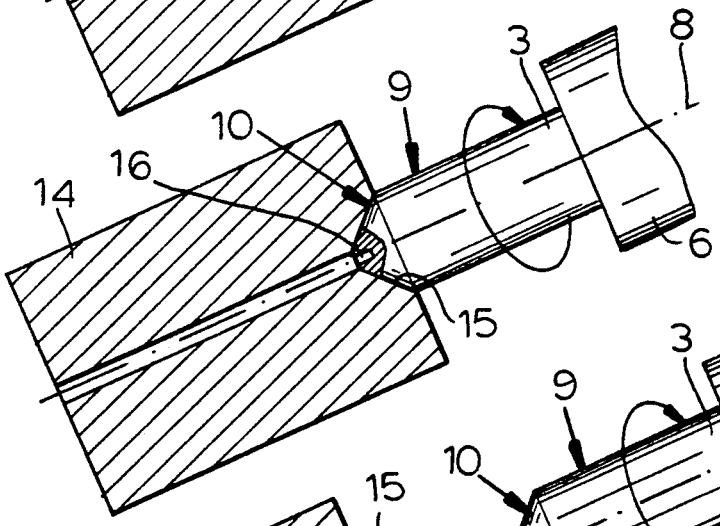
Figure 4D:
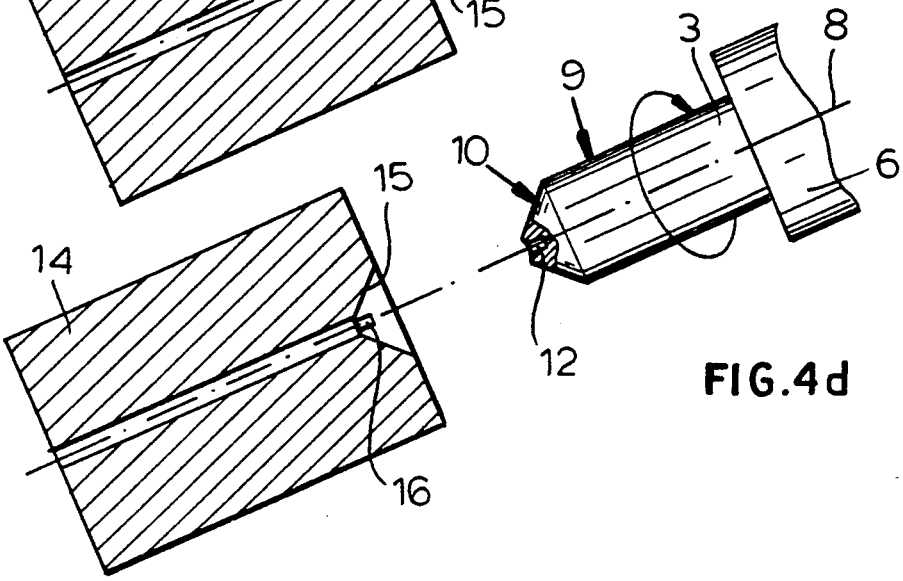

The worn tool 3 is reground by means of a tool 14 having a frustoconical cavity 15 and provided at the center of this cavity with a part-spherical bump in turn provided with a boring tool 16 as shown in FIG. 4*a*. The worn tool 3 is pushed into this cavity 15 with its axis 8 aligned with that of the cavity 15 and with the drill bit 16 and is rotated as shown in FIGS. 4*b* and 4*c*. This pushes back the frustoconical surface 10 while reforming the surface 11 and the hole 12. The tool 3 can then be removed as shown in FIG. 4*d* and reused, the diameter of the outer periphery of its surface 11 being reduced.

Figure 5:
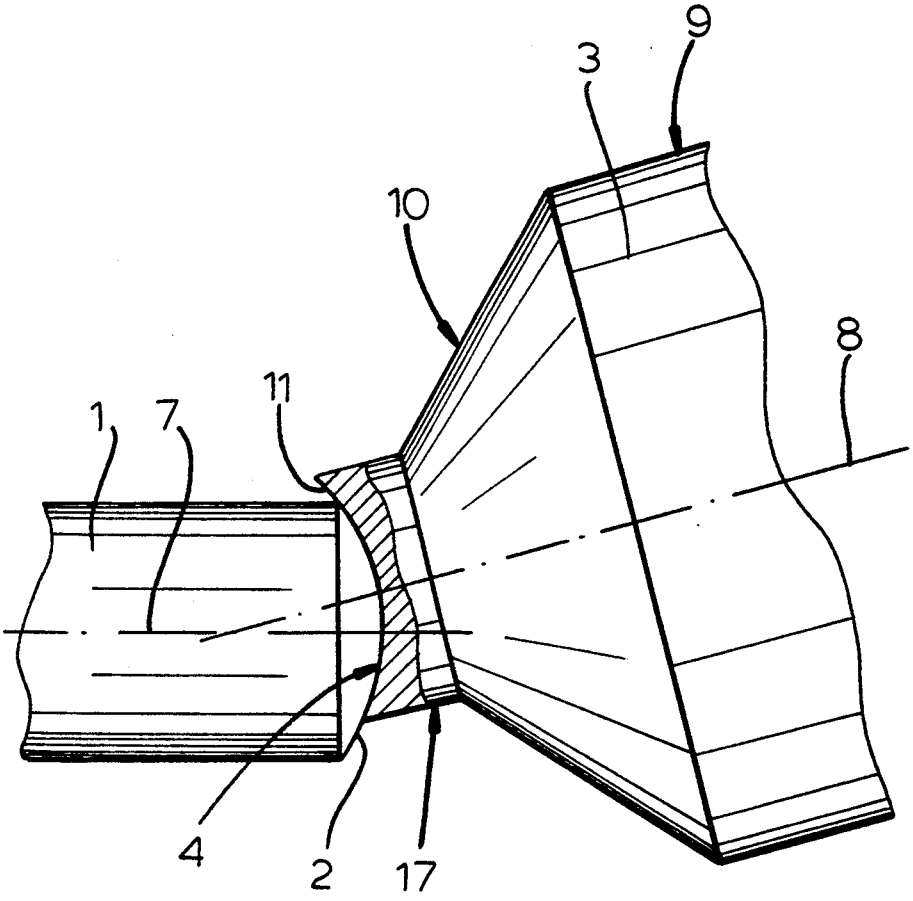
FIG. 5 is a view like FIG. 2 of an alternative tool according to the invention.

FIG. 5 shows an alternative tool according to this invention which has its end 4' formed with a short cylindrical extension 17 centered on the axis 8 and extending from the outer end of the frustoconical surface 10 to the outer periphery of the part-spherical cavity 11.

I claim:

1. A method of fine grinding on a workpiece extending along a workpiece axis a part-spherical surface having a center of curvature at the workpiece axis and a predetermined radius of curvature, the method comprising the steps of:

rotating the workpiece about the workpiece axis;

rotating about a tool axis a tool having a body of substantially greater diameter than the workpiece and an end formed by a part-spherical tool surface having a radius of curvature generally equal to the radius of curvature of the workpiece surface, a center of curvature on the tool axis, an outer periphery of predetermined diameter substantially less than the tool-body diameter, and a generally frustoconical surface region centered on the tool axis and having a small-diameter end adjacent and of generally the same diameter as the seat outer periphery and a large-diameter end spaced axially rearwardly therefrom and joined to the tool body;

positioning the tool and workpiece axes relative to each other so they intersect at an obtuse attack angle smaller than 180° and pressing the tool and workpiece axially together to engage the tool and workpiece surfaces together and thereby grind the workpiece surface, the outer-periphery diameter and the attack angle being such that when axially engaged a portion of the workpiece surface is not covered by the tool surface and a portion of the tool surface is not engaged by the workpiece surface, whereby the outer-periphery diameter increases as the tool wears; and replacing the tool with a fresh tool when the outer-periphery diameter increases so much that practically all of the workpiece surface is covered by the tool surface.

2. The fine-grinding method defined in claim 1 wherein the tool surface further is formed at the tool axis with an axially centered and forwardly open blind bore of predetermined diameter, the attack angle being such that the bore is radially spaced from the tool axis when the tool and workpiece are axially engaged.

3. The fine-grinding method defined in claim 2 wherein the tool is replaced when the tool surface has worn down generally a floor of the blind bore.

4. The fine-grinding method defined in claim 1 wherein the workpiece has a diameter between 1 mm and 5 mm and the tool-body diameter is between 2 mm and 20 mm.

5. The fine-grinding method defined in claim 1 wherein the frustoconical surface has an apex angle of between 30° and 60°.

6. The fine-grinding method defined in claim 1 wherein the tool surface further is formed at the tool axis with an axially centered and forwardly open blind bore.

7. The fine-grinding method defined in claim 6 wherein the blind bore has an axial depth smaller than the radius of curvature of the workpiece surface.

8. The fine-grinding method defined in claim 7 wherein the blind-bore depth is smaller than half the radius of curvature of the workpiece surface.

9. The fine-grinding method defined in claim 1 wherein the tool end is further formed with a cylindrical extension centered on the tool axis and extending axially from the outer periphery of the tool surface to the small-diameter end of the frusto-conical surface region.

* * * * *